United States Patent [19]

Murphy

[11] 4,169,310

[45] Oct. 2, 1979

[54] WIRE WRAPPING TOOL

[75] Inventor: Charles R. Murphy, Sunnyvale, Calif.

[73] Assignee: Daniel G. Nilsson, Sunnyvale, Calif.

[21] Appl. No.: 883,436

[22] Filed: Mar. 6, 1978

[51] Int. Cl.[2] ..... H01R 5/00; B21F 3/04

[52] U.S. Cl. ..... 29/751; 140/124

[58] Field of Search ..... 29/751, 753; 140/119, 140/122, 124; 242/7.06, 7.17

[56] References Cited

U.S. PATENT DOCUMENTS

| | | | |
|---|---|---|---|
| 3,781,932 | 1/1974 | Baker et al. | 140/124 X |
| 3,882,906 | 5/1975 | Steiner et al. | 140/124 |
| 3,893,491 | 7/1975 | Jackson et al. | 140/122 |
| 3,903,936 | 9/1975 | Bergmann | 140/124 |
| 3,967,661 | 7/1976 | Scoville et al. | 140/124 |
| 4,069,845 | 1/1978 | Ward | 140/124 |
| 4,076,056 | 2/1978 | Dummel | 140/124 X |

*Primary Examiner*—E. M. Combs

*Attorney, Agent, or Firm*—Townsend and Townsend

[57] ABSTRACT

An improved tool for wrapping wire around an electrical terminal to make an electrical connection. The tool includes a bit and a sleeve for receiving the bit. One end of the bit has a connecting member for coupling the bit to the chuck of a hand-held drive motor. The opposite end of the bit is provided with a tip having a recess axially aligned with an axially extending groove formed in one side of the main body of the bit. A discontinuity between the recess and the groove is defined by a ridge having a pair of relatively convergent edges which extend toward the axis of the bit and terminate at a notch axially aligned with the bottom of the groove in the bit body. A crescent shaped projection extends axially outwardly from one side of the tip to wrap the end of the wire against the terminal at the end of a wire wrapping tool. The sleeve has an enlargement at the end near the tip for receiving one end of a wire and guiding it to the groove and outwardly through a side window in the sleeve before rotating the bit. The window is surrounded by a cutting edge which cuts the excess part of the wire when the bit starts to rotate. The sleeve has a stationary bearing therewithin near the enlargement to cause a number of functions to be performed when the bit commences to rotate in the sleeve.

8 Claims, 10 Drawing Figures

WIRE WRAPPING TOOL

This invention relates to a wire wrapping tool for cutting, stripping and wrapping insulated wire around a terminal pin on one operation.

BACKGROUND OF THE INVENTION

Solderless wire wrapping is a most reliable method for making point to point mechanical and electrical connections between wires and terminals. Wires wrapping techniques may be used in many applications where low-cost, high-density wiring is a must and is particularly useful with unsettled circuit designs because wrapped panels are easily modified. Typical applications are found in computer central processors and peripheral equipment, radar units, test equipment, PBX and central office equipment.

Tools for cutting, stripping and wrapping insulated wire have been used in the past, but for the most part, they have been unsatisfactory for one reason or the other. One disadvantage is the way the insulation is cut. Some tools are made such that the wire itself is sometimes cut along with the insulation, thereby weakening the wire and sometimes causing breaking of the wire. All such tools do not give a "modified" wrap that is, a wire wrap connection in which the first turn of the wire on a terminal still has insulation on it. This modified wrap is desirable because it maintains the structural integrity of the first turns of bare wire near the base of the terminal in the event of vibration or shock of the equipment of which the terminal forms a part.

A Typical prior tool of this type is one that is disclosed in U.S. Pat. No. 3,781,932. Tools of this type are also made and sold by Gardner-Denver Company, Electronic Products Division, Grand Haven Michigan, a typical model of the Gardner-Denver tools being known as Part Nos. 521198 and 521199.

SUMMARY OF THE INVENTION

The present invention is directed to an improved wire wrapping tool which avoids the problems of the prior art and provides a cutting, stripping and wrapping operation with insulated wire. The tool operates without having to pre-cut and pre-strip the wire before the wire wrapping operation. Moreover, the tool of the present invention functions with conventional wire wrap tool drive motor and require no special handling or operating technique. The tool of this invention has high reliability and is of a significantly hard material so as to provide a long useful operating life.

To this end, the tool of this invention includes a bit and a sleeve combination with the bit being simple in construction and operatable in a reliable manner to cause cutting of the insulation of a wire and wrapping the wire around a terminal with the wrap being a modified wrap as that term is defined above. The advantages obtained from the use of this tool stem to a large degree from a stationary bearing within the sleeve near one end. This stationary bearing serves to force the wire into a throat in the bit to urge the insulation into engagement with a pair of relatively convergent blades. This causes the insulation to be cut. The bearing further holds the cut insulation in a groove in the bit as the bare wire is wrapped around the terminal. Finally, the bearing forces a part of the insulated wire into a recess in the bit so that the first turn of the wire on the terminal will have insulation on it. Thus, the bearing assures that a modified wrap will be obtained.

As a result, the proper length of wire is wrapped on the terminal a desired number of turns and the insulation is stripped from the wire so as to assure good electrical contact between the terminal and the wire wrapped on it. The stripped insulation remains in the groove and is later forced out of the groove by insertion of the next wire to be wrapped.

The primary object of this invention is to provide an improved wire wrapping tool which is simple and rugged in construction, is inexpensive to produce, has a long operating life and is highly reliable withstanding the fact that the tool can be immediately used by an unskilled worker without any special knowledge of wire wrapping techniques.

Another object of this invention is to provide a tool of the type described wherein the bit of the tool has an improved tip which is received within the enlarged end of the sleeve so as to cleanly cut the insulation of a wire, to properly start the wire wrapping yet provide a modified wrap, and to cut the excess length of the wire immediately upon rotation of the bit within the sleeve, all of which is done in a reliable manner and without waste of wire.

Other objects of this invention will become apparent as the following specification progresses, reference being had to the drawing for an illustration of the invention.

IN THE DRAWINGS

Figures 1, 2, 2A, 2B, 3, 3A, 3B, 4, 5, 6:
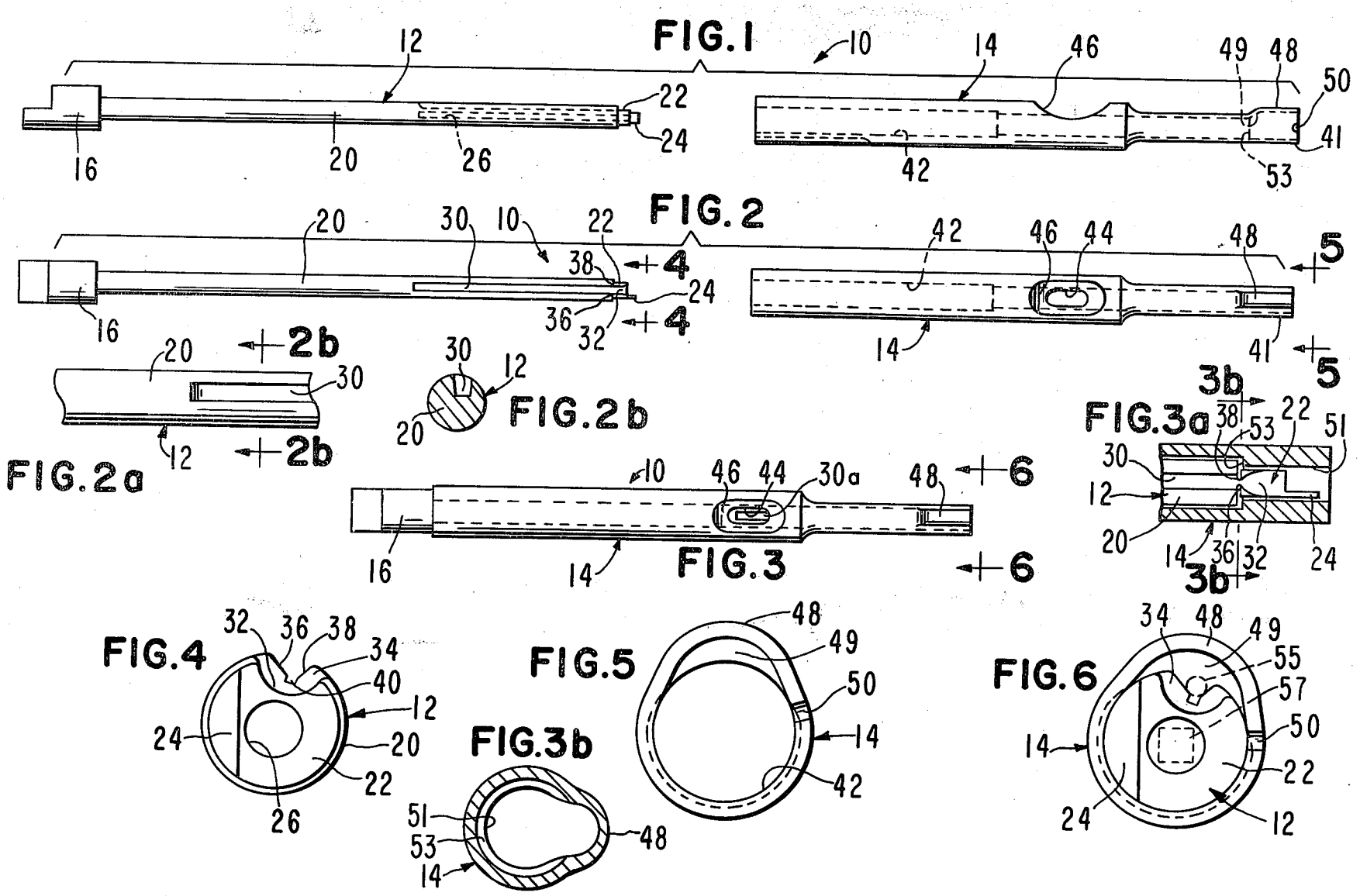
FIG. 1 is a side elevational view of the wire wrapping tool of this invention with the bit of the tool separated from the sleeve.
FIG. 2 is a view similar to FIG. 1 but showing the bit and sleeve rotated through an angle of 90°.

FIG. *2a* is an enlarged, fragmentary, side elevational view of the bit, showing the off-center groove therein;

FIG. *2b* is a cross-sectional view taken along line *2b—2b* of FIG. *2a;*

FIG. 3 is a view similar to FIG. 2 but showing the bit in the sleeve;

FIG. *3a* is an enlarged, fragmentary cross-sectional view of the tool, showing the stationary bearing in one end of the sleeve;

FIG. *3b* is an enlarged cross-sectional view taken along line *3b—3b* of FIG. *3a;*

FIG. 4 is an end elevational view of the bit looking in a direction of line 4—4 of FIG. 2;

FIG. 5 is an end elevational view of the sleeve looking in a direction of line 5—5 of FIG. 2; and FIG. 6 is an end elevational view of the tool looking in a direction of line 6—6 of FIG. 3.

The wire wrapping tool of the present invention is broadly denoted by the numeral 10 and includes a bit 12 and a sleeve 14. The tool is adapted to be coupled to a handheld drive motor (not shown) having a chuck for receiving an end connecting member 16 on bit 12. One end 18 of sleeve 14 is adapted to be coupled in a stationary position to a support on the drive motor so that bit 12 can rotate relative to the sleeve when the bit is in the sleeve.

Bit 12 has an elongated rod-like body 20 with a cylindrical outer surface. Body 20 has an end tip 22 at the end opposite to member 16. Tip 22 is integral with body 20 and typically is formed by turning body 20 down in a machining process.

A crescent shaped projection 24 is integral with tip 22 and extends axially therefrom as shown in FIGS. 1, 2 and 4. The outer, circumferential surface of projection 24 is coextensive with the adjacent outer circumferential surface of tip 22; thus, projection 24 is an extension of tip 22. Projection 24 has an axial length of typically 0.032 inch. The typical axial length of tip 22 is 0.070 inch, and the typical length of body 20 is about 3.125 inches.

Body 20 and tip 22 have a bore 26 (shown in dashed lines in FIG. 1), extending thereinto generally to a location 28 (FIG. 1). This bore is adapted to receive a terminal about which a wire is to be wrapped when tool 10 is in use. Typically, bore 26 is slightly off center with reference to the central axis of body 20, such off center distance being generally in the range of 0.003 to 0.004 inches.

Body 20 has a groove 30 in the side thereof, the groove extending about the same distance from tip 22 as bore 26. Groove 30 is located off-center of the cylindrical outer surface of body 20 as shown in FIGS. *2a* and *2b*. The groove has a generally flat bottom and sloping sides which converge as the bottom groove 30 is approached. Groove 30 is axially aligned with a recess trough 32 in one side of tip 22, there being a discontinuity between groove 30 and recess 32 in the form of a ridge 34 (FIG. 4) having relatively convergent blade edges 36 and 38 for cutting the insulation of a wire between such edges. A notch 40 is at the junction between edges 36 and 38. The acute angle between edges 36 and 38 is slightly less than about 90°. Notch 40 is typically axially aligned with the bottom of groove 30.

Sleeve 14 has an axial length about equal to the combined lengths of body 20 and tip 22 is that tip 22 is adjacent to one end 41 (FIG. 3) of the sleeve when body 20 is in the central bore 42 of the sleeve. The sleeve has an opening or window 44 through the side thereof, the opening being generally elliptical as shown in FIG. 2 and surrounded by a beveled surface 46 which, in side elevation as shown in FIG. 1, is crescent shaped to minimize production problems. The location of opening 44 in sleeve 14 is such that the adjacent end 30*a* of groove 30 is alignable with the opening as shown in FIG. 3 when body 20 of bit 12 is in sleeve 14. End 30*a* has a sloping surface as shown in FIG. 1 to allow the end of a wire to move out of groove 30 and to readily smoothly and easily enter opening 44 prior to a wire wrapping operation. By virtue of the elliptical shape of opening 46, the inner peripheral edge of surface 46 is continuous and presents a cutting edge which smoothly extends axially and outwardly of window 44 to immediately cut a wire extending outwardly of the window as bit 12 commences to rotate within sleeve 14.

Sleeve 14 has a swaged enlargement 48 at end 44. This enlargement extends away from the adjacent end of the sleeve a short distance, such as about 0.25 inch. The enlargement is not precisely aligned axially with window 44 but is slightly off-center therefrom as shown in FIG. 2. This feature is to assure that the enlargement will be axially aligned with groove 30, when bit 12 is in sleeve 14 and before bit 12 is rotated in the sleeve.

Enlargement 4*b* has an inside sloping surface 49 as shown in FIGS. 1 and 5 for guiding the end of a wire into groove 30 before the beginning of a wire wrapping operation. A small notch 50 is formed in the sidewall of the sleeve at the end thereof near enlargement 48 as shown in FIGS. 1, 5 and 6 to receive the adjacent part of the wire when the wire is folded back just prior to the rotation of the bit in the sleeve.

Sleeve 14 has an stationary bearing 51 (FIG. *3a*) extending thereinto from end 41 thereof. This bearing is formed by machining the interior of the sleeve to form a shoulder 53 spaced about 0.82 inch from the end of the sleeve. Bearing 51 would be generally cylindrical but for the presence of enlargement 48; thus, its major portion is generally curved or substantially annular as shown in FIG. *3b* and shoulder 53 is immediately adjacent to blades 36 and 38, as shown in FIG. *3a*, when bit 12 is in sleeve 14. The wall thickness A of bearing 51 is typically about 0.021 inch and the wall thickness B of sleeve 14 is typically 0.016". When bit 12 is in an operative position in sleeve 14, blade edges 36 and 38 are adjacent to shoulder 53 and are movable past the same.

The off-center feature of groove 30 assures that the wire will have minimal pinching or bending as it moves onto the terminal when bit 12 starts to rotate in sleeve 14. Also, when the bit starts to rotate in the sleeve, the end of the wire projecting through window 44 is immediately and clearly cut to avoid problems of wire breakage due to stretching. Furthermore, the insulation part left in groove 30 from one wire wrapping operation will be forced out of the groove when the next wire is forced into the groove prior to the next wire wrapping operation.

This invention allows the wrapping of wire of different sizes in a manner in which the wire need not be pre-cut or pre-stripped before the wrapping operation. The tool of this invention further is useful with conventional hand-held drives adapted for use with prior tools of this general nature. No special operating techniques are required to use tool 10. Moreover, since the tool is simple and rugged in construction, the production cost of the tool is lower than the combination of the regular bit, sleeve, cutter and stripper of conventional or prior art tools. Tool 10 can be made from a material having a significant hardness for a long operating life, and can be used at fast wire wrapping speeds without interruption.

I claim:

1. A wire wrapping tool comprising: a bit and a sleeve, said bit having an elongated body rotatably receivable in the sleeve and means at one end of the body for releasably attaching the same to the chuck of a drive motor, there being a tubular tip rigid to the body at its opposite end, said tip having a recess in one side thereof, said body having a terminal-receiving bore extending thereinto from said tip and a groove in the side thereof in axial alignment with the recess, there being means on the bit at the junction between the recess and the groove for cutting the insulation of a wire in the recess and the groove as the bit rotates in the sleeve, said sleeve having a window alignable with the groove and an enlargement near the tip in radially spaced relationship to the recess when the bit is in the sleeve and when the window is aligned with the groove, and an elongated stationary bearing on the inner surface of the sleeve, said bearing having a shoulder near the cutting means for urging the wire into engagement with the cutting means as the bit rotates relative the sleeve.

2. A wire wrapping tool as set forth in claim 1, wherein said cutting means includes a pair of relatively convergent edges.

3. A wire wrapping tool as set forth in claim 2, wherein is included means defining a notch at the junction of said edges.

4. A wire wrapping tool as set forth in claim 1, wherein said stationary bearing comprises a projection on the inner surface of the sleeve near a first end of the sleeve, the inner end of the projection defining the shoulder.

5. A wire wrapping tool as set forth in claim 1, wherein said groove is off-center relative to the outer surface of the bit body.

6. A wire wrapping tool as set forth in claim 1, wherein the bore and the groove are of substantially the same length.

7. A wire wrapping tool as set forth in claim 1, wherein the window extends longitudinally of the sleeve, said sleeve having a continuous wire-cutting edge surrounding the window.

8. A wire wrapping tool comprising: a bit and an open end sleeve, said bit having an elongated body rotatably receivable in the sleeve and a connector member at one end of the body for releasably attaching the same to the chuck of a drive motor, there being a tubular tip rigid to the body at its opposite end, said tip having a recess in one side thereof, said body having a terminal-receiving bore extending thereinto from said tip and a groove in the side thereof in axial alignment with the recess, there being a pair of relatively convergent cutting edges at the junction between the recess and the groove, said edges being in a plane generally perpendicular to the longitudinal axis of the bit and being operable for cutting the insulation of a wire in the recess and the groove as the bit rotates in the sleeve, said sleeve having a window in the side thereof, the window being alignable with the groove, said sleeve having an enlargement near the tip in radially spaced relationship to the recess when the bit is in the sleeve and when the window is aligned with the groove, there being an elongated projection on the inner surface of the sleeve near the tip, the inner end of the projection defining a curved shoulder, said shoulder being operable to urge the wire into engagement with said cutting edges as the bit rotates relative to the sleeve to cause the insulation on the wire to be cut by the edges.

* * * * *